US005467938A

United States Patent [19]

Redman

[11] Patent Number: 5,467,938

[45] Date of Patent: Nov. 21, 1995

[54] SPOOL HAVING ADJUSTABLE END PLATES

[76] Inventor: David W. Redman, Rte. 14, Box 72, Hendersonville, N.C. 28792

[21] Appl. No.: 123,049

[22] Filed: Sep. 20, 1993

[51] Int. Cl.[6] ..... B65H 49/00; B65H 75/14

[52] U.S. Cl. ..... 242/599.1; 242/609.1; 242/615.3; 242/118.5; 242/129.6

[58] Field of Search ..... 242/129.6, 129.62, 242/599.1, 599.4, 615.3, 608.2, 609.1, 118.4, 118.5, 128; 83/649, 650

[56] References Cited

U.S. PATENT DOCUMENTS

| | | | |
|---|---|---|---|
| 1,028,506 | 6/1912 | Thieme | 242/129.6 |
| 1,473,678 | 11/1923 | Holmquist | 242/599.4 X |
| 1,603,394 | 10/1926 | McPhee | 242/129.6 |
| 2,185,642 | 1/1940 | McVeigh et al. | 242/118.5 |
| 2,317,431 | 4/1943 | Baal | 242/118.4 |
| 3,830,445 | 8/1974 | Moore | 242/128 X |
| 4,022,393 | 5/1977 | Curcio | 242/608.2 X |
| 4,068,808 | 1/1978 | King | 242/118.4 |
| 4,132,372 | 1/1979 | Worrell | 242/129.62 |
| 4,537,106 | 8/1985 | Rider | 242/129.62 X |
| 4,867,391 | 9/1989 | Resch | 242/118.5 |
| 4,967,973 | 11/1990 | Murnane | 242/129.6 X |

*Primary Examiner*—Daniel P. Stodola
*Assistant Examiner*—Michael R. Mansen

[57] ABSTRACT

A spool assembly is arranged for mounting an individual or a plurality of cable wrapped thereabout, with the spool having a central shaft including first and second end plates arranged for displacement relative to one another along coaxially aligned and telescoping shafts using interlocking structure between the shafts. The structure is arranged for mounting employing support hangers secured to a central support shaft directed through the spool.

4 Claims, 4 Drawing Sheets

FIG. 7
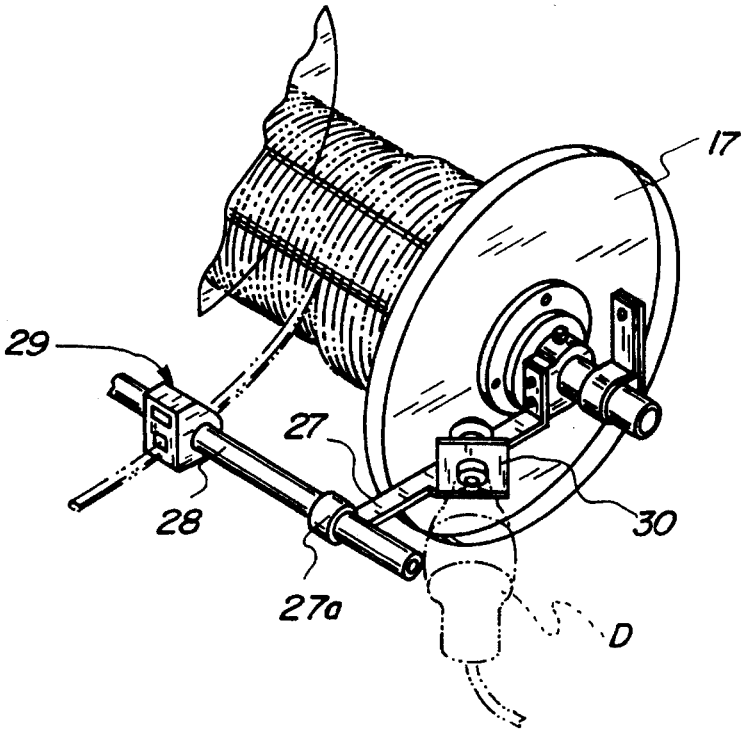
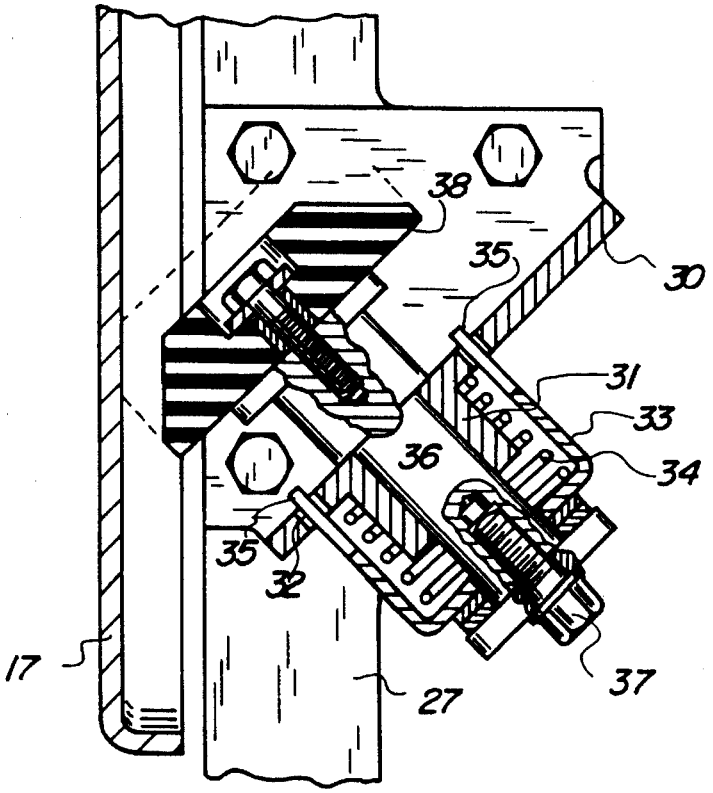
FIG. 8

SPOOL HAVING ADJUSTABLE END PLATES

BACKGROUND OF THE INVENTION

1. Field of the Invention

The field of invention relates to spool apparatus, and more particularly pertains to a new and improved spool apparatus arranged for the adjustable positioning of end plates relative to one another.

2. Description of the Prior Art

Spool apparatus of various types are utilized throughout the prior art for dispensing of various cable and the like. Typically, such cable may be varied as to the quantity positioned thereon and the instant invention attempts to overcome deficiencies of the prior art by providing for ease of adjusting the end plates relative to one another to accommodate cable of various sizing and turns about the spool structure and to this end, the present invention substantially fulfills this need.

SUMMARY OF THE INVENTION

In view of the foregoing disadvantages inherent in the known types of spool apparatus now present in the prior art, the present invention provides a spool apparatus including telescoping first and second tubes mounted about a central support shaft. As such, the general purpose of the present invention, which will be described subsequently in greater detail, is to provide a new and improved spool apparatus which has all the advantages of the prior art spool apparatus and none of the disadvantages.

To attain this, the present invention provides a spool assembly arranged for mounting an individual or a plurality of cable wrapped thereabout, with the spool having a central shaft including first and second end plates arranged for displacement relative to one another along coaxially aligned and telscoping shafts using interlocking structure between the shafts. The structure is arranged for mounting employing support hangers secured to a central support shaft directed through the spool.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of t-he foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved spool apparatus which has all the advantages of the prior art spool apparatus and none of the disadvantages.

It is another object of the present invention to provide a new and improved spool apparatus which may be easily and efficiently manufactured and marketed.

It is a further object of the present invention to provide a new and improved spool apparatus which is of a durable and reliable construction.

An even further object of the present invention is to provide a new and improved spool apparatus which is susceptible of a low cost of manufacture with regard to both materials and labor, and which accordingly is then susceptible of low prices of sale to the consuming public, thereby making such spool apparatus economically available to the buying public.

Still yet another object of the present invention is to provide a new and improved spool apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 7 is an isometric illustration of the invention employing a reeling mechanism.

FIG. 8 is an enlarged view, partially in section, of the reeling mechanism as indicated in FIG. 7.

DESCRIPTION OF THE PREFERRED EMBODIMENT

Figure 1:
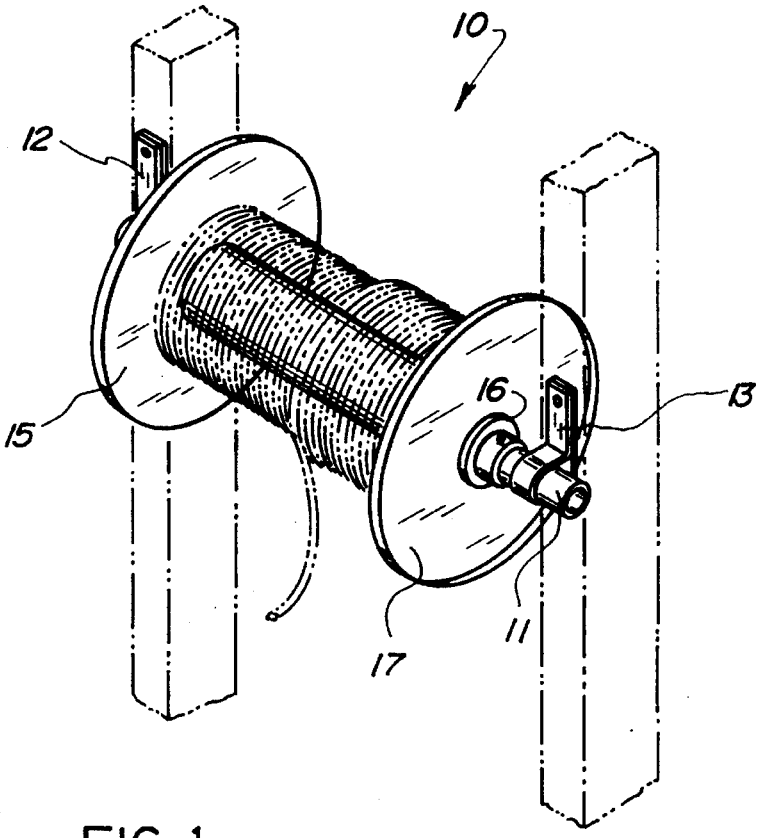
FIG. 1 is an isometric illustration of the invention.
Figure 2:
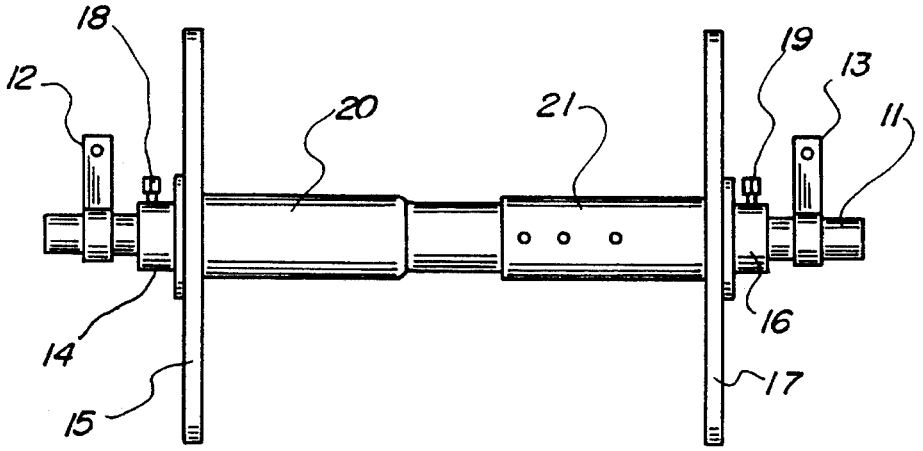
FIG. 2 is an orthographic frontal view of the invention.
Figure 3:
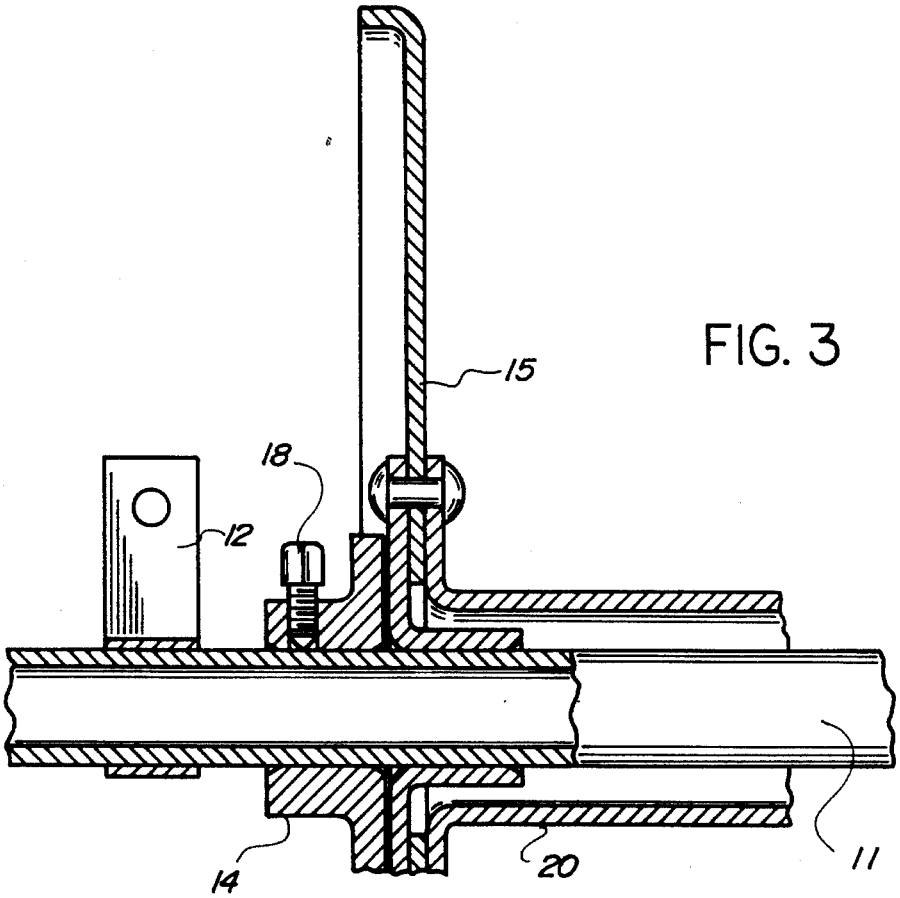
FIG. 3 is an orthographic cross-sectional view of the end plate structure.

With reference now to the drawings, and in particular to FIGS. 1 to 8 thereof, a new and improved spool apparatus embodying the principles and concepts of the present invention and generally designated by the reference numeral 10 will be described.

Figure 4:
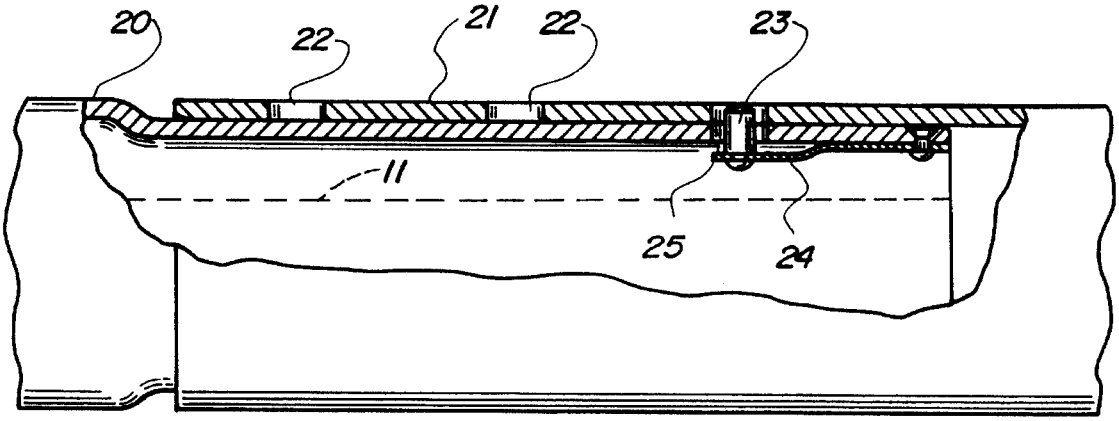
FIG. 4 is an enlarged orthographic view, partially in section, of the interconnection of the first and second tubes.

More specifically, the spool apparatus 10 of the instant invention essentially comprises a central shaft 11, including spaced first and second support hangers 12 and 13 respectively fixedly secured to the central shaft 11 adjacent opposed first and second ends of the support shaft. First and second collars 14 and 16 are mounted in adjacency to the respective first and second support hangers. Fixedly mounted to the first and second collars are respective first and second end plates 15 and 17, with the first and second collars and their associated first and second end plates including respective first and second support tubes 20 and 21 arranged for telescoping and coaxially aligned securement relative to one another, in a manner as indicated in FIG. 4, with the first and second support tubes coaxially aligned relative to the first and second end plates 15 and 17. The first and second support tubes in association with the respective first and second end plates and the respective first and second collars are arranged for rotation about the central shaft 11. To effect interlocking of the first and second collars relative to the central shaft, respective first and second fastener rods 18 and 19 are directed through the respective first and second collars for engagement with the central shaft 11. The first and second support tubes 20 and 21 and their interlocking engagement is indicated in the FIG. 4, such that the first support tube is received within the second support tube, with the second support tube having a row of second support tube apertures 22 each arranged for selective alignment with a first tube pin receiving aperture 25, having a lock pin 23 positioned therewithin. The lock pin is biased through the first tube pin receiving aperture 25 for reception within one of the second tube apertures 22, with a lock pin spring 24 mounted within the first support tube and secured to the lock pin for its biasing through the first pin receiving aperture 25, as illustrated in FIG. 4. The central shaft in FIG. 4 is illustrated in phantom to note its being directed through the first and second support tubes 20 and 21 but indicated in phantom for ease of viewing the interlocking relationship of the first and second support tubes.

Figure 5:
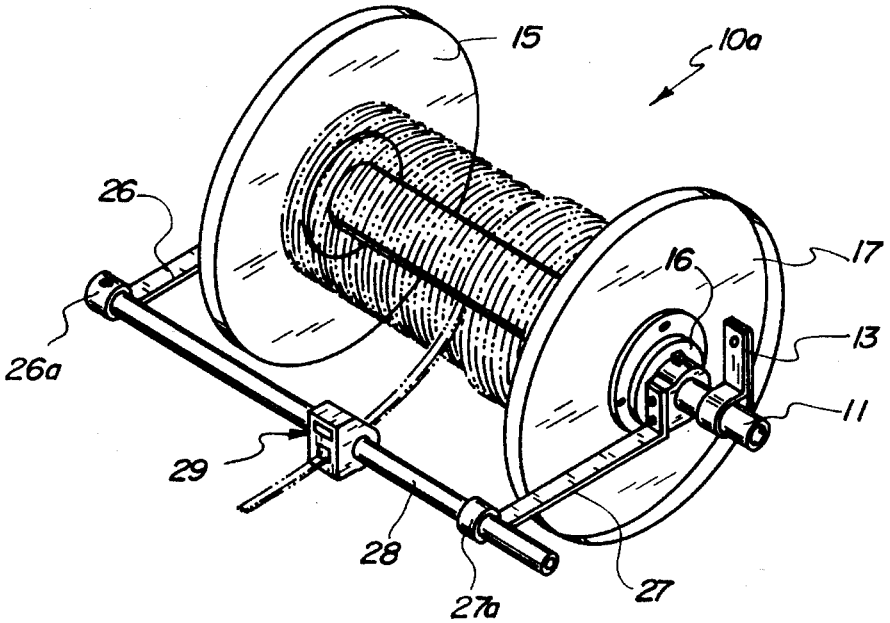
FIG. 5 is an isometric illustration of the invention employing a counter mechanism.
Figure 6:
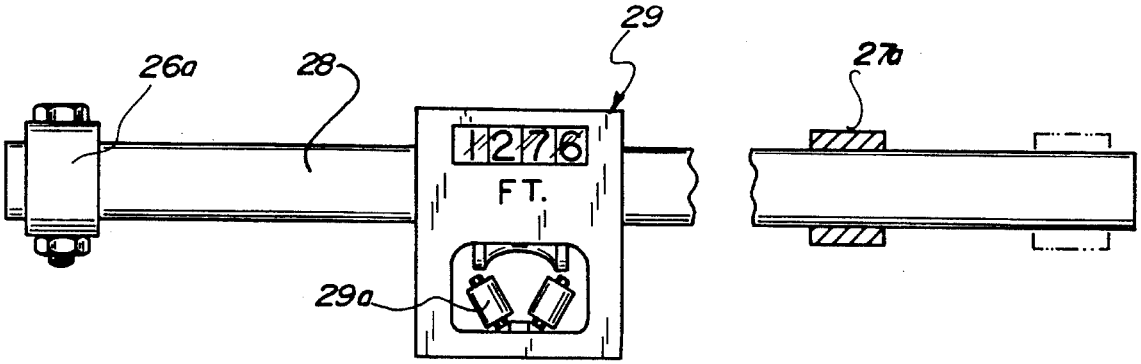
FIG. 6 is an orthographic view of the counter mechanism mounted to its respective shaft.

The FIGS. 5 and 6 indicates the use of respective first and second extension arms 26 and 27 fixedly mounted and extending from the respective first and second collars 14 and 16 terminating in respective first and second sleeves **26*a* and 27*a*. The first and second collars 15 and 16 are arrayed for relative rotation to the central shaft 11 in the embodiment indicated as "10*a*" of FIGS. 5 and 8. The first sleeve 26*a* is fixedly mounted to an extension arm shaft 28 that in turn is parallel to the central shaft 11 spaced from the central shaft and the first and second end plates 15 and 17. The second sleeve 27*a* mounted to an outer distal end of the second extension arm 27 slidably receives the extension arm shaft 28 therethrough to permit and accommodate adjustment in telescoping the first and second support tubes relative to one another, as described above. The extension arm shaft 28 includes a counter mechanism 29 having a through-extending bore to receive cable directed therethrough, as indicated in FIG. 5, with the through-extending bore including guide rollers 29*a*** arranged within the bore in surrounding relationship relative to the cable to be directed therethrough to effect rotation of the guide rollers.

The FIGS. 7 and 8 indicates the use of a winding mechanism, wherein a support plate 30 is fixedly mounted to the second extension arm 27 in adjacency to the second end plate 17. The support plate includes a central boss 31 (see FIG. 8), with the support plate 30 including a plurality of openings 32 arranged to receive the fingers 35 of a hub 33 that is positioned in surrounding relationship relative to the central boss 31, with a hub spring 34 positioned within the hub 33 between the hub and the support plate 30 in surrounding relationship relative to the central boss 31. The hub shaft 36 is directed coaxially of the hub and the central boss 31, including a hub shaft extension 37 projecting exteriorly of the hub for securement to a drill "D", as illustrated in FIG. 7. A truncated conical plate engaging head 38 is mounted to the hub shaft 36 between the support plate 30 and the second end plate 17 for engagement with the second end plate upon projection of the hub shaft 36 towards the second end plate and simultaneous compression of the hub spring 34. In this manner, rotation of the hub shaft 36 as rotatably directed through the hub 33 and the central boss 31 effects rotation of the engaging head 38 for rotation of the second end plate 15 and a winding of the spool structure.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A spool apparatus, comprising, a central shaft, the central shaft having a first support hanger and a second support hanger spaced relative to one another mounted to said central shaft, and a first collar positioned in adjacency to the first hanger and a second collar positioned about said central shaft in adjacency to the second hanger, a first end plate secured to the first collar and a second end plate secured to the second collar, with the first end plate and the second end plate arranged in a parallel spaced relationship receiving the central shaft coaxially therethrough, and a first support tube fixedly and coaxially mounted to the first end plate and extending towards the second end plate, and a second support tube telescopingly receiving the first support tube, with the second support tube fixedly and coaxially mounted to the second end plate and extending towards the first end plate, and latch means for securing the first support tube and the second support tube in a telescoping relationship to one another, wherein the latch means includes a row of second support tube apertures directed along the second support tube, and a pin receiving aperture directed through the first support tube, with the pin receiving aperture arranged for alignment with one of said second support tube apertures, and a lock pin positioned within the pin receiving aperture and a lock pin spring mounted to said lock pin and fixedly secured within said first support tube to direct said lock pin into said pin receiving aperture and into one of said support tube apertures.

2. An apparatus as set forth in claim 1 wherein the first collar includes a first lock fastener arranged for selective engagement with the central shaft, and the second collar includes a second lock fastener arranged for selective engagement with the central shaft.

3. A spool apparatus, comprising, a central shaft, the central shaft having a first support hanger and a second support hanger spaced relative to one another mounted to said central shaft, and a first collar positioned in adjacency to the first hanger and a second collar positioned about said central shaft in adjacency to the second hanger, a first end plate secured to the first collar and a second end plate secured to the second collar, with the first end plate and the second end plate arranged in a parallel spaced relationship receiving the central shaft coaxially therethrough, and a first support tube fixedly and coaxially mounted to the first end plate and extending towards the second end plate, and a second support tube telescopingly receiving the first support tube, with the second support tube fixedly and coaxially mounted to the second end plate and extending towards the first end plate, and latch means for securing the first support tube and the second support tube in a telescoping relationship relative to one another, the latch means includes a row of second support tube apertures directed along the second support tube, and a pin receiving aperture directed through the first support tube, with the pin receiving aperture arranged for alignment with one of said second support tube apertures, and a lock pin positioned within the pin receiving aperture arranged for reception within one of said second support tube apertures.

4. An apparatus as set forth in claim 3 wherein the first collar includes a first lock fastener arranged for selective engagement with the central shaft, and the second collar includes a second lock fastener arranged for selective engagement with the central shaft.

* * * * *